US007727342B2

(12) United States Patent
Waid et al.

(10) Patent No.: US 7,727,342 B2
(45) Date of Patent: Jun. 1, 2010

(54) LOW CARBON MICROALLOYED STEEL

(75) Inventors: George M. Waid, Orwell, OH (US); John C. Murza, Canton, OH (US); Jeffrey E. Luksa, Brecksville, OH (US)

(73) Assignee: The Timken Company, Canton, OH (US)

( * ) Notice: Subject to any disclaimer, the term of this patent is extended or adjusted under 35 U.S.C. 154(b) by 0 days.

(21) Appl. No.: 10/504,285

(22) PCT Filed: Feb. 12, 2003

(86) PCT No.: PCT/US03/04090

§ 371 (c)(1), (2), (4) Date: Mar. 18, 2005

(87) PCT Pub. No.: WO03/069008

PCT Pub. Date: Aug. 21, 2003

(65) Prior Publication Data

US 2005/0178479 A1 Aug. 18, 2005

(51) Int. Cl.
*C22C 38/42* (2006.01)
*C22C 38/46* (2006.01)
*C22C 38/48* (2006.01)

(52) U.S. Cl. ..... 148/405; 148/332; 148/335

(58) Field of Classification Search ..... 148/320, 148/332, 333, 335, 405; 420/109
See application file for complete search history.

(56) References Cited

U.S. PATENT DOCUMENTS 3,741,822 A * 6/1973 Gorton ..... 148/333
4,008,103 A 2/1977 Miyoshi et al.
6,090,226 A * 7/2000 Hasegawa et al. ..... 148/320
6,551,419 B2 * 4/2003 Kanisawa et al. ..... 148/320
6,866,724 B2 * 3/2005 Ochi et al. ..... 148/320
2003/0221753 A1 * 12/2003 Toyooka et al. ..... 148/593

FOREIGN PATENT DOCUMENTS

EP 0 481 575 A 4/1992
JP 05-148535 * 6/1993
JP 5-148535 A 6/1993
JP 07252594 A * 10/1995
JP 09194998 A * 7/1997
JP 2001032034 A * 2/2001
JP 2001049388 A * 2/2001

OTHER PUBLICATIONS

C.W. Wegst: "Stahlschlüssel"2001, *Verlag Stahlschlüssel Wegst*, Marbach XP002244200, p. 81.

* cited by examiner

*Primary Examiner*—George Wyszomierski
*Assistant Examiner*—Tima M McGuthry-Banks
(74) *Attorney, Agent, or Firm*—The Webb Law Firm

(57) ABSTRACT

A low carbon microalloyed steel, comprising in weight % about: 0.05-0.30 C; 0.5-1.5 Mn; 0.04 max S; 0.025 max P; 1.0 max Si; 0.5-2.0 Ni; 0.05-0.30 V; 0-2.0 Cu; up to 0.0250 N; up to 0.2 Cb; up to 0.3 Cr; up to about 0.15 Mo; up to about 0.05 Al; balance Fe and minor additions and impurities. The steel has a carbon equivalent value, C.E., ranging between 0.3-0.65, calculated by the formula: C.E.=C+Mn+Si+Cu+Ni+Cr+Mo+V+Cb 6 15 5.

7 Claims, 1 Drawing Sheet

EFFECT OF FERRITE TRANSFORMATION TEMPERATURE ($Ar_3$) ON THE CONTRIBUTION FROM PRECIPITATION STRENGTHENING ($\Delta YS_P$)

EFFECT OF FERRITE TRANSFORMATION TEMPERATURE ($Ar_3$) ON THE CONTRIBUTION FROM PRECIPITATION STRENGTHENING ($\Delta YS_p$)

LOW CARBON MICROALLOYED STEEL

BACKGROUND OF THE INVENTION

The present invention relates generally to the metallurgy of steel and, more particularly, to low carbon microalloyed steel compositions. It is common practice to use conventional microalloyed steels in various applications for bars and tubular products. However, there are needs for stronger and tougher microalloyed steels in a number of different applications such as, for example, in communication towers and hub assemblies.

SUMMARY OF THE INVENTION

The steels of the present invention are much more weldable and tougher than conventional microalloyed steels. The present invention is directed to an alloy broadly comprising in wt. %, about 0.05-0.30 C; up to 1.5 Mn; 1.0 max Si; 0.5-2 Ni; 0.05-0.3 V; up to 2 Cu; 10-250 ppm N; balance Fe and other minor additions and impurities.

DETAILED DESCRIPTION OF THE INVENTION

Figure 1:
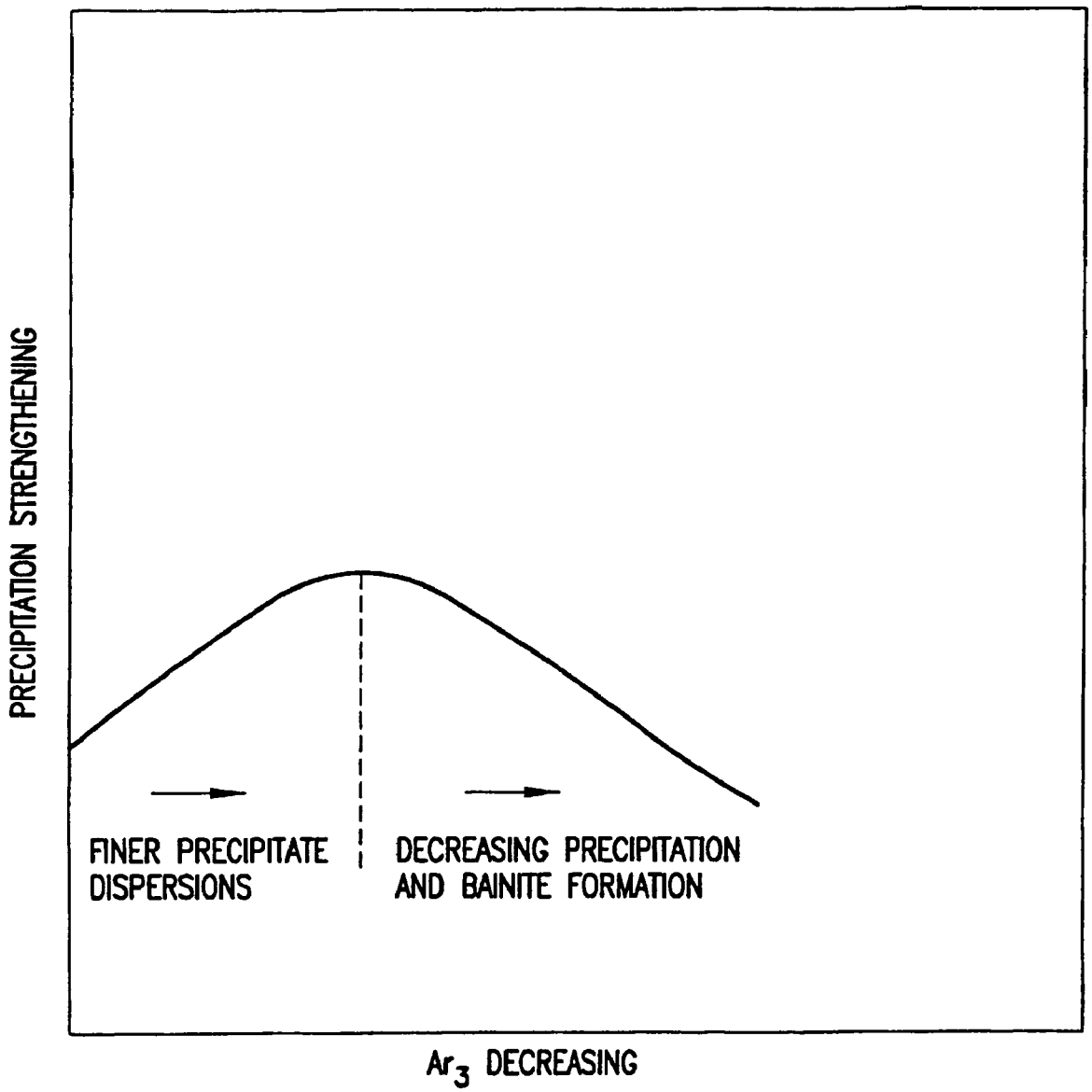
FIG. 1 is a graph schematically showing the relationship between the precipitation strengthening factor ($\Delta YS_p$) and the $Ar_3$ temperature in the steels of the present invention.

The family of microalloyed steels of the present invention provide better weldability and much higher impact toughness and tensile ductility than conventional microalloyed steels. A critical factor in the design of microalloyed ferrite pearlite steels is the extent to which precipitation strengthening supplements the base strength provided by solid solution and grain refinement. It is known that this precipitation strengthening factor, referred to as $\Delta YS_p$, is controlled by the ferrite transformation temperature, $Ar_3$, all other things being equal. As the $Ar_3$ temperature is lowered, $\Delta YS_p$ increases up to a maximum and then decreases as a result of precipitation suppression through the usual kinetic limitations at lower temperatures. This relationship is graphically depicted in FIG. 1. The essential design factor for high strength involving precipitation is to adjust $Ar_3$ by compositional means to allow this maximum to be obtained. Either under (lean) or over (rich) adjustment of the chemistry of the alloy may lead to underutilization of precipitation. Accordingly, two factors must be considered in order to optimize the precipitation according to the invention. The first factor is whether the base composition is too close to the critical limit for formation of bainite such that any further increase in either Mn or Ni (both lower the $Ar_3$ temperature) causes unwanted bainite formation. The second factor is that for a given $Ar_3$ temperature, Mn is less potent than Ni in that it suppresses precipitation. Thus, the invention requires the Mn levels to be below 1.5 wt. % and that the $Ar_3$ temperature be controlled with elements which have a low tendency for forming bainite.

Consideration of these requirements shows that out of all the common alloying elements, Ni is the most effective. The results of a study to examine the effect of Ni on $\Delta YS_p$ showed that 45 ksi minimum yield strength and as high as 80 ksi was possible for large bars or tubular products. The results are given in the following tables.

One presently preferred alloy composition according to the present invention contains in % by weight: 0.05-0.30 C, 0.5-1.5 Mn; 1.0 max Si; 0.5-2.0 Ni; 0.05-0.30 V; 0-2.0 Cu; 0.0050-0.0250 N; balance Fe and other minor additions and impurities. The S level is 0.04 wt. % max and preferably about 0.035 wt. % max. The P content is 0.025 wt. % max and preferably about 0.02 wt. % max. In the above composition, the C and N contents may preferably be 0.05-0.15 wt. % C and 0.0010-0.0250 wt. % N.

A further presently preferred embodiment of the present invention includes the alloy composition set forth above, also containing about 0.25-2.0 wt. % Cu. Copper in these microalloyed steels will form as ϵ-copper particles by both interphase precipitation and the normal nucleation and growth process, thus increasing strength by increasing $\Delta YS_p$, and maintaining high levels of toughness and tensile ductility as seen in Tables III and IV.

The alloy may also contain additional constituents such as Cr, Mo, Cb and Al, for example, 0.05-0.3 Cr, up to about 0.15 Mo, up to about 0.2 Cb, up to about 0.05 Al, and more preferably about 0.01-0.03 Al.

TABLE I

| | Chemical Compositions | | | | | | | | | | | | |
|---|---|---|---|---|---|---|---|---|---|---|---|---|---|
| Heat No. | C | Mn | P | S | Si | Cr | Ni | Mo | Cu | Al | V | N(ppm) | C.E.* |
| 2032 | 0.08 | 0.52 | 0.005 | 0.004 | 0.25 | 0.12 | 1.03 | 0.03 | 0.01 | 0.022 | 0.144 | 103 | 0.34 |
| 2033 | 0.14 | 0.53 | 0.004 | 0.004 | 0.26 | 0.12 | 1.03 | 0.03 | 0.01 | 0.026 | 0.146 | 106 | 0.40 |
| 2034 | 0.07 | 0.52 | 0.004 | 0.004 | 0.27 | 0.11 | 1.03 | 0.03 | 0.01 | 0.026 | 0.152 | 20 | 0.33 |
| 2035 | 0.13 | 0.52 | 0.004 | 0.004 | 0.26 | 0.11 | 1.05 | 0.03 | 0.01 | 0.026 | 0.138 | 20 | 0.39 |
| 2036 | 0.07 | 0.98 | 0.005 | 0.004 | 0.25 | 0.11 | 1.04 | 0.03 | 0.01 | 0.021 | 0.143 | 107 | 0.40 |
| 2037 | 0.14 | 1.02 | 0.005 | 0.004 | 0.26 | 0.12 | 1.03 | 0.03 | 0.01 | 0.024 | 0.140 | 112 | 0.48 |
| 2057 | 0.06 | 1.03 | 0.004 | 0.005 | 0.26 | 0.12 | 1.03 | 0.03 | 0.01 | 0.025 | 0.146 | 174 | 0.40 |
| 2058 | 0.11 | 1.04 | 0.004 | 0.005 | 0.28 | 0.12 | 1.04 | 0.04 | 0.01 | 0.017 | 0.150 | 164 | 0.46 |
| 2059 | 0.08 | 1.06 | 0.004 | 0.005 | 0.26 | 0.12 | 1.54 | 0.03 | 0.01 | 0.023 | 0.131 | 186 | 0.46 |
| 2060 | 0.13 | 1.03 | 0.004 | 0.005 | 0.25 | 0.12 | 1.52 | 0.03 | 0.01 | 0.023 | 0.148 | 187 | 0.51 |
| 2061 | 0.07 | 1.03 | 0.004 | 0.005 | 0.27 | 0.12 | 1.04 | 0.03 | 0.01 | 0.024 | 0.249 | 184 | 0.44 |
| 2062 | 0.12 | 1.03 | 0.004 | 0.005 | 0.26 | 0.12 | 1.03 | 0.03 | 0.01 | 0.029 | 0.250 | 176 | 0.48 |
| 2063 | 0.08 | 1.02 | 0.004 | 0.006 | 0.26 | 0.12 | 1.03 | 0.03 | 0.50 | 0.025 | 0.152 | 180 | 0.46 |
| 2135 | 0.16 | 1.04 | 0.004 | 0.004 | 0.26 | 0.14 | 1.5 | 0.03 | 0.01 | 0.028 | 0.138 | 166 | 0.54 |
| 2136 | 0.26 | 1.00 | 0.003 | 0.004 | 0.26 | 0.13 | 1.5 | 0.03 | 0.01 | 0.028 | 0.137 | 170 | 0.63 |

TABLE I-continued

Chemical Compositions

| Heat No. | C | Mn | P | S | Si | Cr | Ni | Mo | Cu | Al | V | N(ppm) | C.E.* |
|---|---|---|---|---|---|---|---|---|---|---|---|---|---|
| 2137 | 0.19 | 1.00 | 0.004 | 0.004 | 0.26 | 0.14 | 0.98 | 0.03 | 0.01 | 0.025 | 0.227 | 168 | 0.55 |
| 2138 | 0.28 | 1.00 | 0.004 | 0.003 | 0.26 | 0.14 | 0.96 | 0.03 | 0.01 | 0.028 | 0.218 | 156 | 0.63 |

$$*\text{C.E.} = \text{C} + \frac{\text{Mn}+\text{Si}}{6} + \frac{\text{Cu}+\text{Ni}}{15} + \frac{\text{Cr}+\text{Mo}+\text{V}+\text{Cb}}{5}$$

TABLE II

Rolling Schedule (1) All billets had a 2250° F. soak
(2) Rolling Sequence:

| Pass No. | Reduction (Inches) |
|---|---|
| 1 | 2.625-2.000 |
| 2 | 2.000-1.750 |
| 3 | 1.750-1.500 |
| 4 | 1.500-1.250 |

TABLE II-continued

Rolling Schedule

| | |
|---|---|
| 5 | 1.25-1.000 |
| 6 | Cross Roll to Straighten Plate (No reduction) |

(3) Finish Rolling Temperature (approximately 1950° F. to 2000° F.)
(4) No designation after heat number: Air cooled
"S" designation after heat number: Sand cooled to simulate the mid-radius position of a 6-inch bar

TABLE III

Tensile Properties and Hardness

| Heat No. | Yield Strength (0.2% offset) (ksi) | Ultimate Tensile Strength (ksi) | Elongation (Percent in 1.4") | R.A. (Percent) | Hardness ($R_B$) |
|---|---|---|---|---|---|
| 2032 | 54.6 | 70.3 | 32.0 | 77.1 | 81 |
| 2032 S | 47.7 | 64.6 | 32.7 | 74.7 | 74 |
| 2033 | 61.3 | 80.8 | 28.9 | 70.6 | 87 |
| 2033 S | 51.4 | 73.1 | 28.6 | 67.4 | 81 |
| 2034 | 50.2 | 68.3 | 31.1 | 76.9 | 80 |
| 2034 S | 46.4 | 65.2 | 33.1 | 77.5 | 74 |
| 2035 | 56.4 | 79.2 | 27.8 | 71.1 | 86 |
| 2035 S | 48.2 | 70.3 | 30.4 | 69.7 | 79 |
| 2036 | 61.9 | 79.7 | 28.2 | 77.1 | 87 |
| 2036 S | 52.2 | 74.3 | 28.9 | 77.2 | 82 |
| 2037 | 70.3 | 90.8 | 28.4 | 72.1 | 92 |
| 2037 S | 62.3 | 83.6 | 29.9 | 70.6 | 88 |
| 2057 | 64.8 | 84.9 | 28.0 | 75.8 | 91 |
| 2057 S | 56.8 | 76.0 | 30.5 | 74.4 | 85 |
| 2058 | 68.3 | 87.4 | 28.4 | 74.2 | 92 |
| 2058 S | 60.1 | 80.6 | 28.4 | 73.7 | 87 |
| 2059 | 71.0 | 95.1 | 26.1 | 72.9 | 95 |
| 2059 S | 66.4 | 87.0 | 27.8 | 74.0 | 92 |
| 2060 | 75.6 | 101.6 | 24.4 | 68.3 | 98 |
| 2060 S | 70.3 | 95.6 | 24.1 | 67.2 | 95 |
| 2061 | 69.8 | 90.6 | 26.2 | 75.3 | 94 |
| 2061 S | 60.8 | 79.6 | 27.1 | 75.6 | 88 |
| 2062 | 74.8 | 100.2 | 23.8 | 65.5 | 97 |
| 2062 S | 67.4 | 90.4 | 24.2 | 65.7 | 94 |
| 2063 | 70.8 | 90.8 | 26.6 | 71.8 | 93 |
| 2063 S | 65.5 | 84.8 | 28.1 | 72.6 | 90 |
| 2135 | 80.3 | 109.7 | 23.5 | 67.9 | 98 |
| 2135 S | 72.7 | 100.2 | 25.1 | 67.3 | 94 |
| 2136 | 89.2 | 129.2 | 20.3 | 53.7 | 103 |
| 2136 S | 82.6 | 116.4 | 21.2 | 55.8 | 99 |
| 2137 | 89.2 | 118.3 | 21 | 54.7 | 100 |
| 2137 S | 74.3 | 103.5 | 22.6 | 57.3 | 96 |
| 2138 | 103 | 136.7 | 15.9 | 39.5 | 104 |
| 2138 S | 82.7 | 117.8 | 17.9 | 47.6 | 100 |

TABLE IV

| Heat No. | Impact Toughness Charpy V-notch Impact Toughness (ft-lbs) Test Temperature +40° F. | 0° F. | −20° F. | −60° F. |
|---|---|---|---|---|
| 2031 | 264.0 | 106.0 | 9.5 | 5.0 |
| | — | 13.0 | 11.0 | — |
| 2032 S | — | 262.0 | 20.0 | 8.0 |
| | — | 260.0 | 113.0 | 7.5 |
| 2033 | 79.5 | 10.5 | 10.5 | — |
| | 15.5 | 25.5 | 5.0 | — |
| 2033 S | 81.0 | 26.5 | 9.0 | — |
| | 102.0 | 51.5 | 11.0 | — |
| 2034 | 270.0 | 7.0 | 6.5 | 3.0 |
| | — | — | 5.5 | — |
| 2034 S | 266.0 | 12.5 | 6.0 | 3.5 |
| | — | 8.0 | 9.0 | — |
| 2035 | 14.5 | 9.0 | 8.0 | — |
| | 9.0 | 12.0 | 3.5 | — |
| 2035 S | 10.0 | 9.0 | 5.5 | — |
| | 31.0 | 8.5 | 6.0 | — |
| 2036 | 97.5 | 7.0 | 10.0 | — |
| | 222.0 | 112.0 | 6.0 | — |
| 2036 S | — | 280.0 | 160.0 | 4.0 |
| | — | — | 8.0 | 9.5 |
| 2037 | 68.5 | 57.5 | 44.0 | — |
| | 92.5 | 37.0 | 56.5 | — |
| 2037 S | 110.0 | 81.5 | 91.5 | — |
| | 121.0 | 90.0 | 70.0 | — |
| 2057 | 84.5 | 107.5 | 7.5 | 5.0 |
| | — | 108.0 | 53.0 | 23.0 |
| 2057 S | 219.0 | 153.0 | 124.0 | 2.5 |
| | — | — | 77.5 | 53.0 |
| 2058 | 112.0 | 84.5 | 53.5 | 9.5 |
| | — | 57.0 | 43.0 | 16.0 |
| 2058 S | 144.0 | 95.0 | 104.0 | 41.5 |
| | — | 102.5 | 75.5 | 6.0 |
| 2059 | 59.0 | 6.5 | 26.5 | 4.0 |
| | — | — | 41.0 | 3.0 |
| 2059 S | 107.0 | 88.5 | 49.5 | 9.5 |
| | — | 81.0 | 51.5 | 7.0 |
| 2060 | 32.5 | 8.5 | 6.0 | 2.0 |
| | — | 29.5 | 6.0 | 4.5 |
| 2061 | 45.5 | 24.5 | 24.5 | 5.0 |
| | — | 14.5 | 6.0 | 8.0 |
| 2061 S | 125.0 | 103.5 | 60.0 | 6.0 |
| | — | 92.0 | 19.0 | 8.5 |
| 2062 | 11.0 | 11.0 | 12.0 | 3.5 |
| | — | 25.0 | 10.5 | 3.5 |
| 2062 S | 26.0 | 7.5 | 2.5 | 3.0 |
| | — | 37.0 | 5.0 | 11.5 |
| 2063 | 63.0 | 16.5 | 18.0 | 22.5 |
| | — | 17.5 | 16.0 | 7.5 |
| 2063 S | 127.0 | 115.0 | 74.5 | 57.5 |
| | — | 76.5 | 52.5 | 7.5 |

| Heat No. | +250° F. | +205° F. | +150° F. | +68° F. | +32° F. |
|---|---|---|---|---|---|
| 2135 | — | 75.5 | 48.5 | 24.5 | 19.0 |
| | — | — | 66.0 | 18.5 | 7.0 |
| | — | — | — | 30.5 | — |
| 2135 S | — | 94.5 | 74.5 | 51.5 | 52.5 |
| | — | — | 83.0 | 43.0 | 34.0 |
| | — | — | — | 60.0 | — |
| 2136 | 48.0 | 28.0 | 24.0 | 12.5 | — |
| | — | 21.5 | 20.0 | 8.0 | — |
| | — | — | — | 15.0 | — |
| 2136 S | 57.0 | 37.5 | 27.5 | 20.0 | — |
| | — | 39.0 | 24.5 | 20.5 | — |
| | — | — | — | 18.5 | — |
| 2137 | 49.5 | 28.5 | 25.5 | 6.0 | — |
| | — | 31.5 | 18.0 | 10.0 | — |
| | — | — | — | 13.5 | — |
| 2137 S | 49.5 | 55.5 | 37.0 | 26.0 | — |
| | — | 36.0 | 42.5 | 11.5 | — |
| | — | — | — | 19.0 | — |

TABLE IV-continued

| Heat No. | Impact Toughness Charpy V-notch Impact Toughness (ft-lbs) Test Temperature | | | | |
|---|---|---|---|---|---|
| 2138 | 20.5 | 18.5 | 12.0 | 7.0 | — |
| | 23.0 | 13.5 | 14.0 | 10.0 | — |
| | 20.0 | — | — | 8.0 | — |
| 2138 S | 36.5 | 24.5 | 20.5 | 5.0 | — |
| | 31.5 | 24.0 | 21.0 | 9.5 | — |
| | — | — | — | 8.0 | — |

The "C.E." or carbon equivalent values reported in Table I may broadly range between 0.3 and 0.65 but, more preferably, are controlled within a range of 0.3 to 0.55 and, still more preferably, controlled within a range of 0.4-0.5 to ensure superior physical properties. The C.E. value of an alloy is calculated using the following formula:

$$C.E. = C + \frac{Mn + Si}{6} + \frac{Cu + Ni}{15} + \frac{Cr + Mo + V + Cb}{5}$$

Various alloy compositions of the present invention are set forth in Table I which also includes the calculated C.E. values for each. Table II describes the rolling schedule for each of the steel alloy heats made from the compositions of Table I. It will be noted that the billets were either air cooled after completion of rolling or they were sand cooled to simulate the mid-radius position of a large diameter bar of, for example, a 6-inch diameter bar. These sand cooled rolled heats have an "S" designation in Tables III and IV while the rolled heats that, were air cooled have no letter designation in the tables.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A low carbon microalloyed steel tube or bar, in a hot rolled and air cooled condition having a microstructure consisting precipitation strengthened ferrite and pearlite, said steel consisting essentially of in weight %: 0.06-0.30 C; 0.5-1.5 Mn; 0.04 max S; 0.025 max P; 1.0 max Si; >1.0-2.0 Ni; 0.05-0.30 V; 0.01-2.0 Cu; 0.0010-0.0250 N; up to 0.2 Cb; 0.05-0.3 Cr; up to 0.15 Mo; 0.01-0.03 Al; balance Fe and minor additions and impurities, and wherein said steel has a carbon equivalent value, C.E., ranging between 0.3-0.55, calculated by the formula:

$$C.E. = C + \frac{Mn + Si}{6} + \frac{Cu + Ni}{15} + \frac{Cr + Mo + V + Cb}{5}.$$

2. The steel of claim 1 containing 0.25-2.0 Cu.

3. The steel of claim 1 containing >0.1-0.30 V.

4. The steel of claim 1 containing 0.06-0.15 C.

5. The steel of claim 1 in the form of a bar or tubular shape having a minimum yield strength of 45-80 ksi.

6. The steel of claim 5 having a minimum yield strength of 65 ksi.

7. A hot rolled and air cooled low carbon microalloyed steel in the form of a bar or tubular shape having a minimum yield strength of between 45-80 ksi and having a microstructure consisting of precipitation strengthened ferrite and pearlite, said steel consisting essentially of in weight %: 0.06-0.30 C; 0.5-1.5 Mn; 1.0 max Si; 0.04 max S; 0.025 max P; >1.0-2.0 Ni; >0.1-0.3 V; 0.01-2.0 Cu; 10-250 ppm N; up to 0.2 Cb; 0.05-0.3 Cr; up to 0.15 Mo; 0.01-0.03 Al; balance Fe and incidental additions and impurities; wherein said steel has a carbon equivalent value, C.E., of between about 0.3-0.55, derived from the following formula:

$$C.E. = C + \frac{Mn + Si}{6} + \frac{Cu + Ni}{15} + \frac{Cr + Mo + V + Cb}{5}.$$

* * * * *

UNITED STATES PATENT AND TRADEMARK OFFICE

CERTIFICATE OF CORRECTION

PATENT NO. : 7,727,342 B2
APPLICATION NO. : 10/504285
DATED : June 1, 2010
INVENTOR(S) : Waid et al.

It is certified that error appears in the above-identified patent and that said Letters Patent is hereby corrected as shown below:

Column 6, lines 46-47, Claim 1, "consisting precipitation strengthened" should read
-- consisting of precipitation strengthened --

Signed and Sealed this

Twelfth Day of October, 2010

David J. Kappos

David J. Kappos
*Director of the United States Patent and Trademark Office*